US007995700B2

(12) United States Patent
Lee et al.

(10) Patent No.: US 7,995,700 B2
(45) Date of Patent: Aug. 9, 2011

(54) REAR DOOR SYSTEM FOR TRANSFERRING HOT CELL EQUIPMENT

(75) Inventors: Eun Pyo Lee, Daejeon (KR); Gil Sung You, Daejeon (KR); Ji Sup Yoon, Daejeon (KR); Won Myung Choung, Daejeon (KR); Jeong Hoe Ku, Daejeon (KR); Il Je Cho, Daejeon (KR); Dong Hak Kook, Daejeon (KR); Kie Chan Kwon, Daejeon (KR); Won Kyung Lee, Daejeon (KR)

(73) Assignees: Korea Atomic Energy Research Institute, Daejon-si (KR); Korea Hydro & Nuclear Power Co., Ltd., Seoul (KR)

( * ) Notice: Subject to any disclaimer, the term of this patent is extended or adjusted under 35 U.S.C. 154(b) by 920 days.

(21) Appl. No.: 11/768,940

(22) Filed: Jun. 27, 2007

(65) Prior Publication Data

US 2008/0179551 A1 Jul. 31, 2008

(30) Foreign Application Priority Data

Jun. 28, 2006 (KR) ..... 10-2006-0058578

(51) Int. Cl.
*G21C 19/00* (2006.01)

(52) U.S. Cl. ..... 376/268; 376/270; 376/272

(58) Field of Classification Search ..... 376/268, 376/270, 272

See application file for complete search history.

(56) References Cited

U.S. PATENT DOCUMENTS

| | | | | | |
|---|---|---|---|---|---|
| 3,445,012 | A | * | 5/1969 | Freeborg | 414/146 |
| 3,910,006 | A | * | 10/1975 | James | 53/468 |
| 3,940,577 | A | * | 2/1976 | Christofer | 191/12 R |
| 4,681,706 | A | * | 7/1987 | Mallory et al. | 588/3 |
| 4,825,769 | A | * | 5/1989 | Watts | 104/107 |
| 5,251,245 | A | | 10/1993 | Evans et al. | |
| 5,695,443 | A | * | 12/1997 | Brent et al. | 588/249 |
| 2007/0095570 | A1 | | 5/2007 | Roberts, IV et al. | |

OTHER PUBLICATIONS

Detailed Response to DNFSB Staff Issues and Observations, by B.D. Smith, pp. 25-32, Sep. 3, 2002.

* cited by examiner

*Primary Examiner* — Rick Palabrica
*Assistant Examiner* — Erin M Leach
(74) *Attorney, Agent, or Firm* — Bachman & LaPointe, P.C.

(57) ABSTRACT

A rear door system for transferring hot cell equipment into or out of a hot cell is disclosed. The rear door system of the present invention includes a rear door, which is provided to a rear wall of the hot cell so as to be movable to open or close the rear wall of the hot cell, and a vertical moving table, which is provided at a predetermined position on the lower portion of the front surface of the rear door so as to be movable upwards or downwards. The rear door system further includes a drive unit, which is provided at a predetermined position in the lower end of the rear door to move the rear door, and a stationary working table, which is disposed above the vertical moving table and is fixed in the hot cell in a horizontal orientation. The rear door system further includes a removable table, which is removably coupled at a predetermined position to the stationary working table, and a hot cell crane hook and a service area crane hook, which are respectively provided inside and outside the hot cell.

4 Claims, 10 Drawing Sheets

REAR DOOR SYSTEM FOR TRANSFERRING HOT CELL EQUIPMENT

BACKGROUND OF THE INVENTION

1. Field of the Invention

The present invention relates generally to rear door systems for transferring hot cell equipment, and, more particularly, to a rear door system for transferring hot cell equipment which has an improved structure such that a vertical moving table is vertically moved on the rear door of a large hot cell that handles highly radioactive material but cannot have a roof door, so that an operation of transferring the hot cell equipment, which is relatively large or heavy and is highly radioactive, into or out of the hot cell can be conducted using only the rear door, thus making it easy to transfer the hot cell equipment, and preventing a user from being directly exposed to radiation, thereby preventing the user from being subjected to safety hazards that may occur when transferring the hot cell equipment.

2. Description of the Related Art

As well known to those skilled in the art, large hot cells, which handle highly radioactive material, include rear doors and roof doors.

Here, in the case of hot cell equipment which is relatively small and light and has relatively low radioactivity, the rear door is opened, and then the hot cell equipment is carried into or out of the hot cell therethrough. In the case of hot cell equipment which is relatively large and heavy and has relatively high radioactivity, the roof door is opened and, thereafter, the hot cell equipment is carried into or out of the hot cell therethrough using a crane, which is provided in a service area.

Meanwhile, of the hot cells that handle highly radioactive material, in the case of a hot cell which has no roof door, the hot cell equipment, which is relatively large and heavy and has relatively high radioactivity, cannot be carried into the hot cell. Thus, in the case where there is no roof door, only hot cells that handle radiation material that is relatively small and have relatively low radioactivity have been constructed.

As such, of the hot cells that handle highly radioactive material, in the case of a hot cell which is provided with a rear door but has no roof door, all of the hot cell equipment is carried into or out of the hot cell through the rear door.

Here, in the case of the large hot cell which handles highly radioactive material, radiation shielding walls constituting the hot cell are very thick. Therefore, in space defined by the rear door and areas adjacent to the corresponding radiation shielding wall, there are some areas that a crane in the hot cell and a crane in the service area cannot approach. Hence, there is a problem in that it is difficult to carry the hot cell, which is heavy or large, into or out of the hot cell.

Furthermore, typically, the height of a hot cell working table, which is installed in the hot cell, is 900 mm, and the height of an opening defined by the rear door is 2000 mm. Therefore, the height of a space between the upper end of the opening, defined by the rear door, and the hot cell working table is 1100 mm. However, taking the curved edge of the working table into account, the effective space between the upper end of the opening and the working table is less than 1100 mm. Therefore, it also is very difficult to carry the hot cell equipment, which is large or heavy, into or out of the hot cell. In addition, in the case of hot cell equipment which is small and light but has high radioactivity, there is a problem in that a user may be exposed to large amounts of radiation.

SUMMARY OF THE INVENTION

Accordingly, the present invention has been made keeping in mind the above problems occurring in the prior art, and an object of the present invention is to provide a rear door system for transferring hot cell equipment which has an improved structure such that a vertical moving table is vertically moved on the rear door of a large hot cell that handles highly radioactive material but cannot have a roof door, so that an operation of transferring the hot cell equipment, which is relatively large or heavy and is highly radioactive, into or out of the hot cell can be conducted using only the rear door, thus making it easy to transfer the hot cell equipment, and preventing a user from being directly exposed to radiation, thereby preventing the user from being subjected to safety hazards that may occur when transferring the hot cell equipment.

In order to accomplish the above object, the present invention provides a rear door system for transferring hot cell equipment into or out of a hot cell, including: a rear door provided to a rear wall of the hot cell so as to be movable to open or close the rear wall of the hot cell; a vertical moving table provided at a predetermined position on a lower portion of a front surface of the rear door so as to be movable upwards or downwards; a drive unit provided at a predetermined position in a lower end of the rear door to move the rear door; a stationary working table disposed above the vertical moving table and fixed in the hot cell in a horizontal orientation; a removable table removably coupled at a predetermined position to the stationary working table; and a hot cell crane hook and a service area crane hook respectively provided inside and outside the hot cell.

Preferably, guide rails may be vertically provided at respective predetermined opposite positions on the lower portion of the front surface of the rear door.

Furthermore, the vertical moving table may include: a ball screw provided through an end of the vertical moving table so as to be rotatable; support members provided on respective opposite ends of the ball screw and fastened at respective predetermined positions to the front surface of the rear door; a ball nut coupled to the ball screw so as to be movable upwards or downwards; a bevel gear provided on a lower end of the ball screw; a shaft gear engaging with the bevel gear in a horizontal direction; a rotating shaft coupled at an end thereof to the shaft gear and provided so as to be rotatable; and a moving table driving motor coupled to the rotating shaft.

In addition, at least one rail block may be provided at each of predetermined opposite positions on a rear surface of the vertical moving table.

As well, a receiving space having a predetermined size corresponding to a size of the removable table may be formed at a predetermined position through the stationary working table.

Preferably, a plurality of steel plates, which are attracted by magnetic force, may be provided in an upper surface of the removable table.

Furthermore, a plurality of reinforcing bars may be horizontally provided under a lower surface of the removable table at positions spaced apart from each other in a longitudinal direction at predetermined intervals.

As well, a magnet may be provided on the hot cell crane hook.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
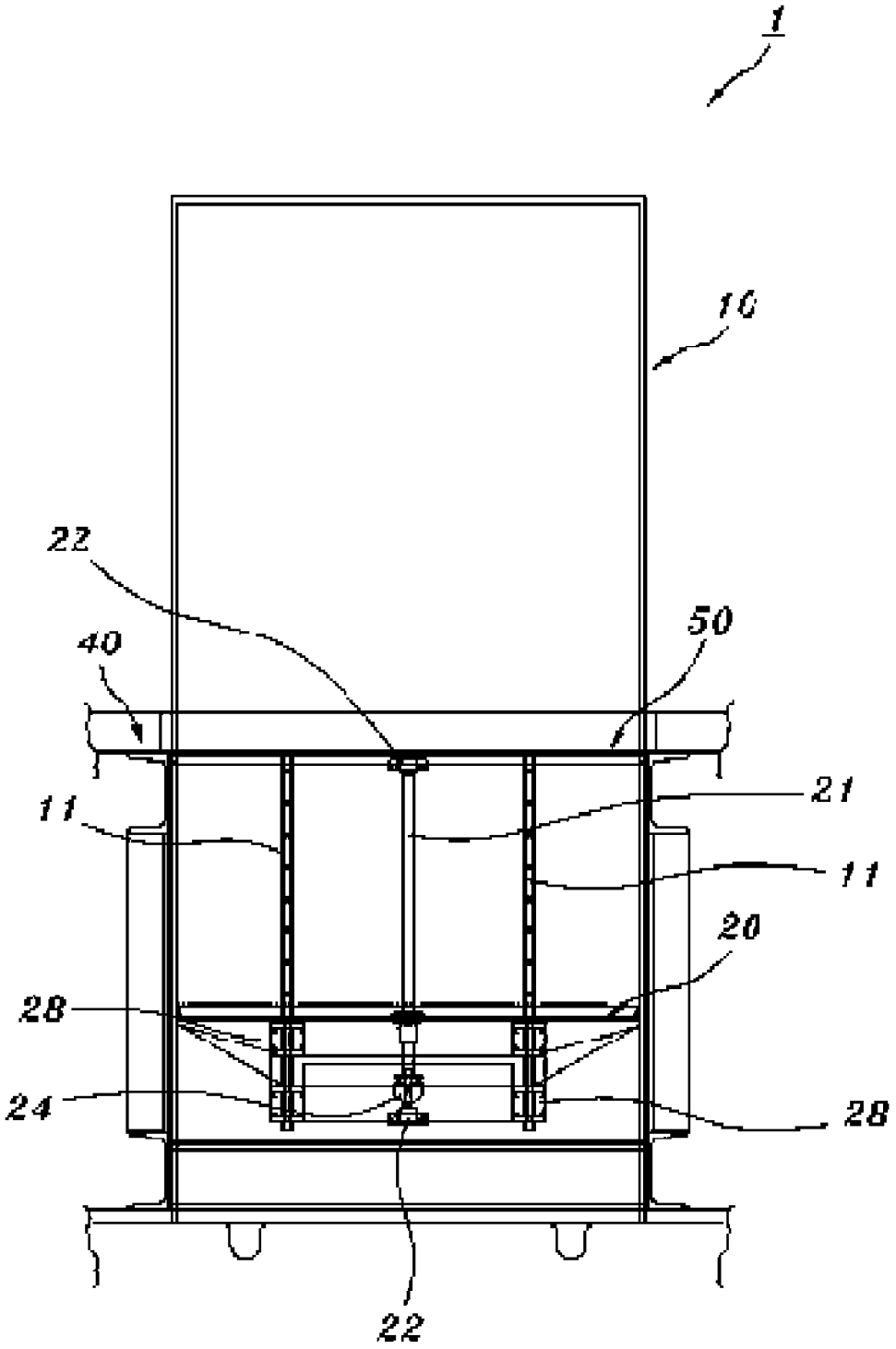
FIG. 1 is a front view schematically showing a rear door system for transferring hot cell equipment, according to an embodiment of the present invention.
Figure 2:
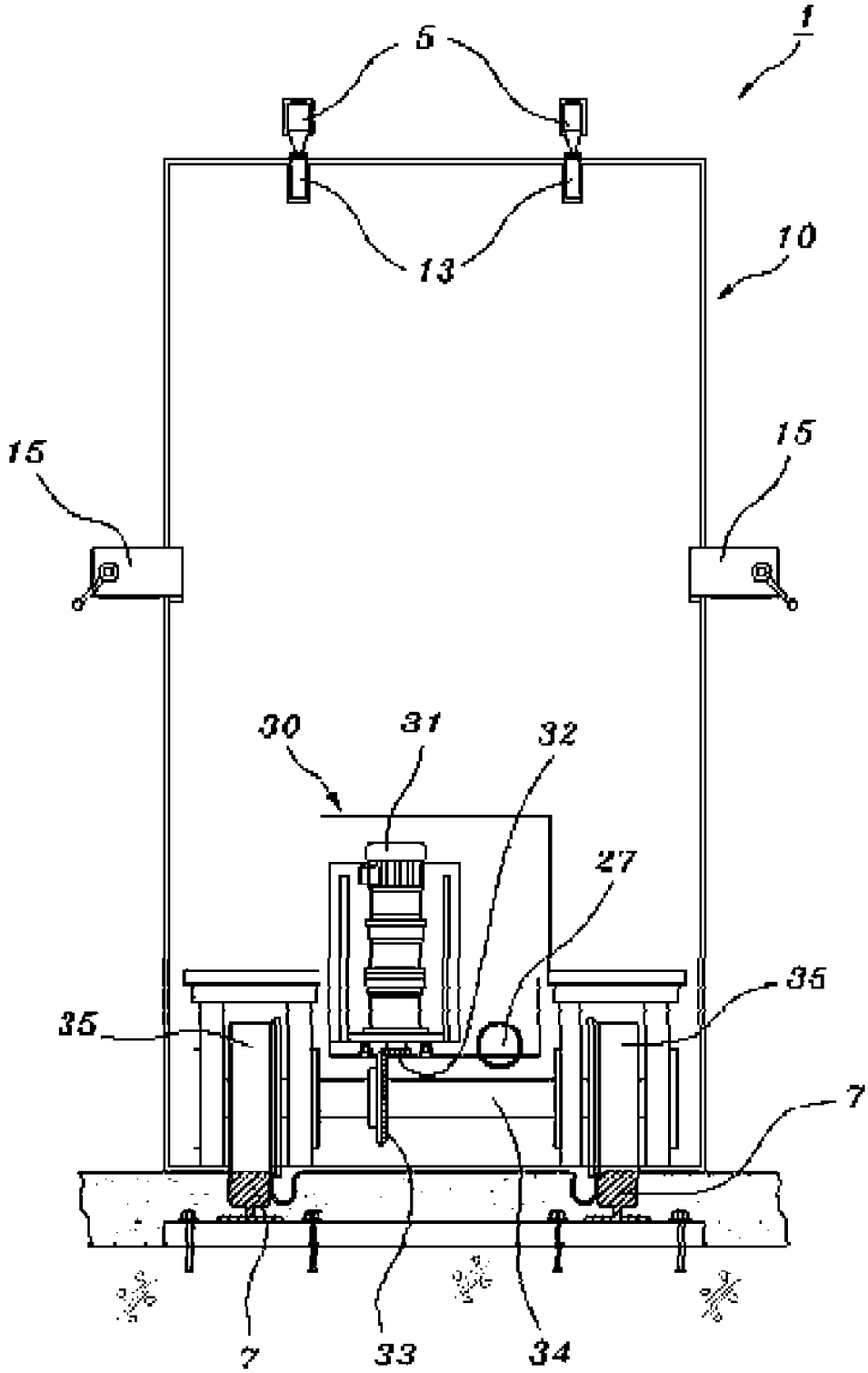
FIG. 2 is a rear view schematically showing the rear door system for transferring the hot cell equipment according to the embodiment of the present invention.
Figure 3:
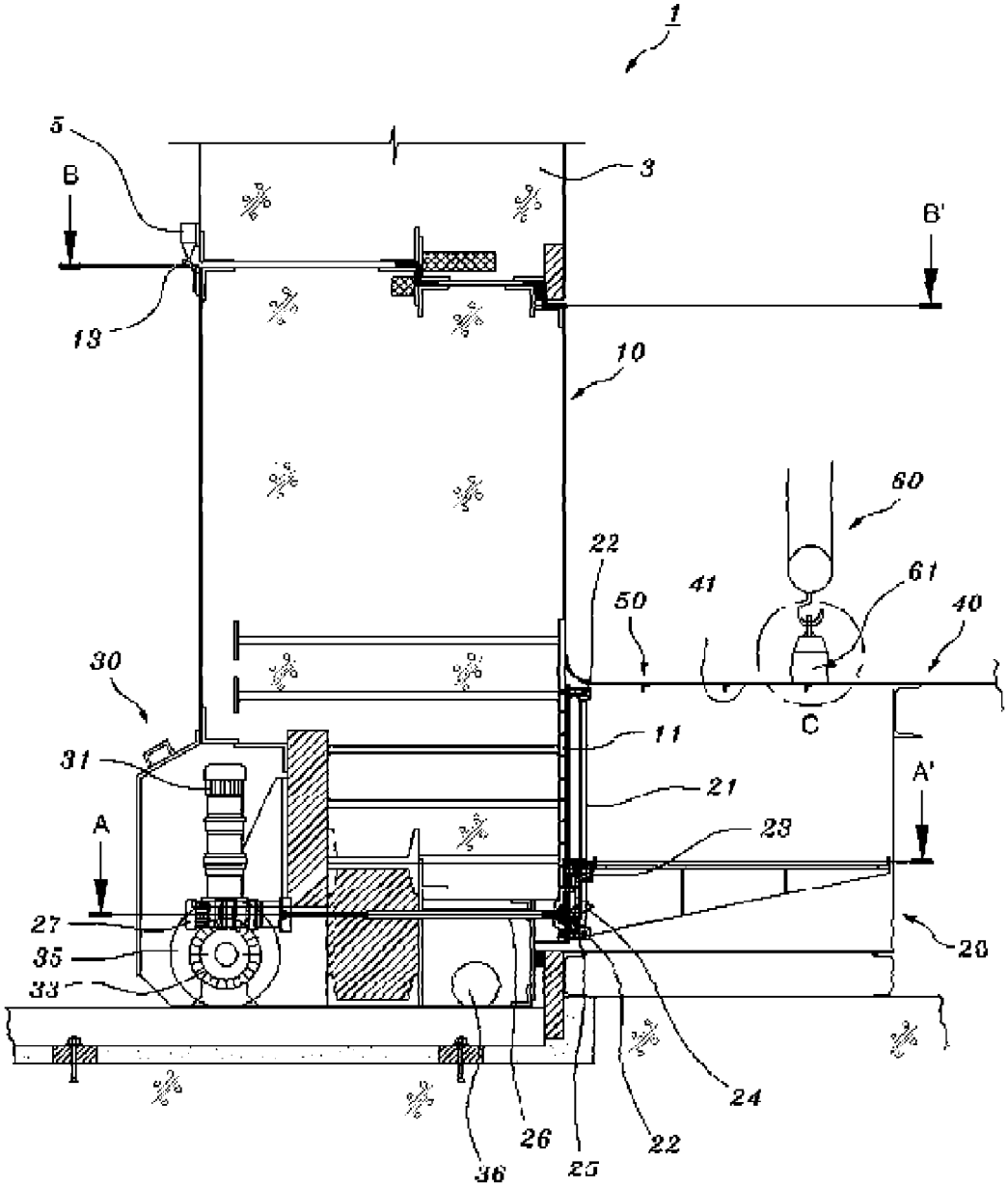
FIG. 3 is a side view schematically showing the rear door system for transferring the hot cell equipment according to the embodiment of the present invention.
Figure 4:
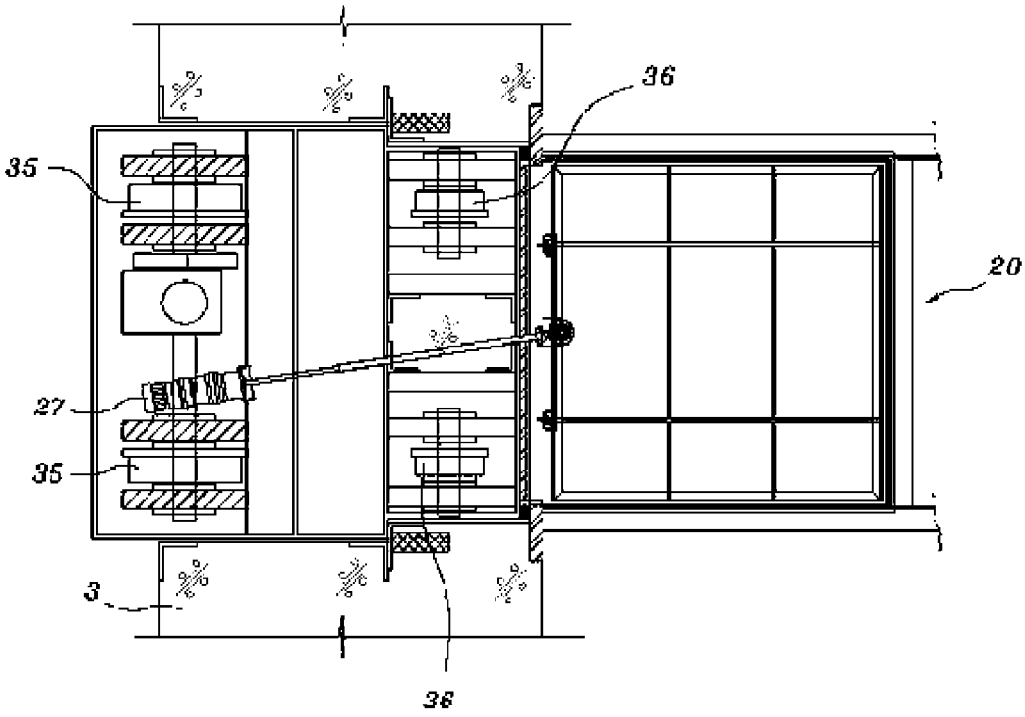
FIG. 4 is a sectional view taken along the line A-A' of FIG. 3.
Figure 5:
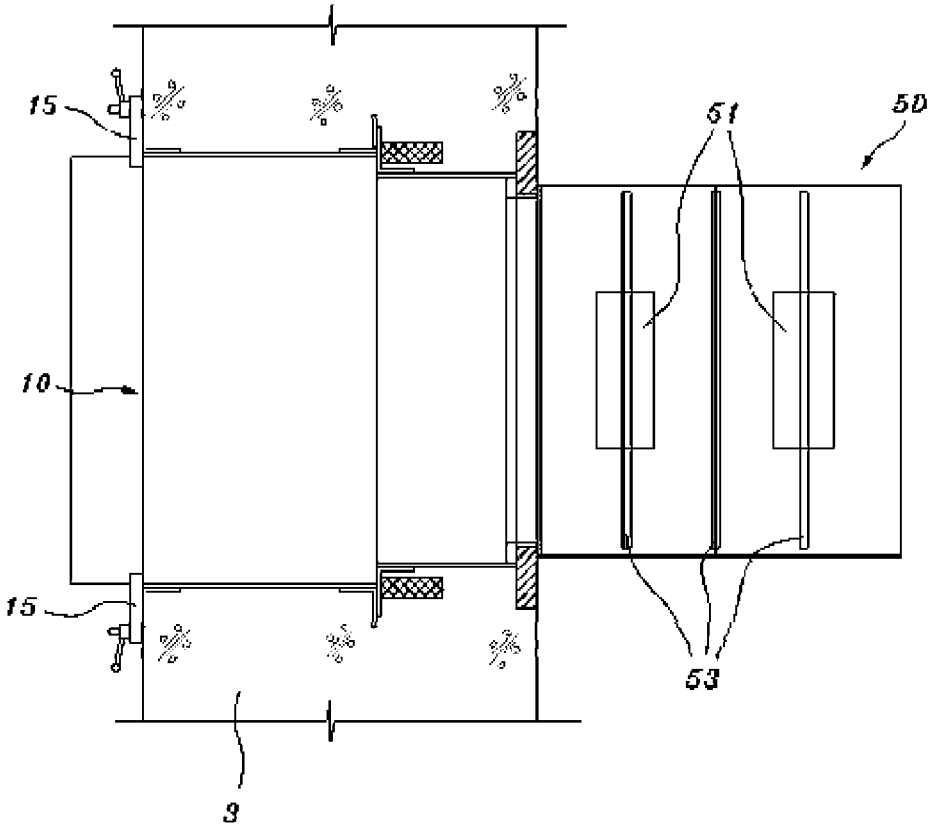
FIG. 5 is a sectional view taken along the line B-B' of FIG. 3.
Figure 6:
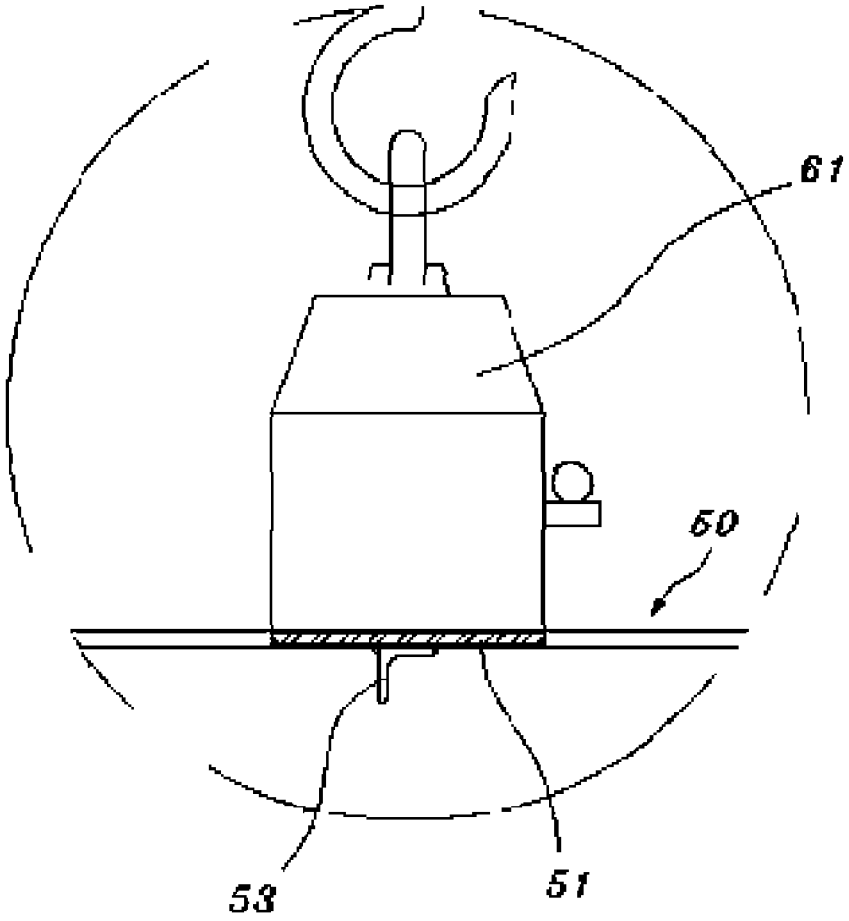
FIG. 6 is an enlarged view of the circled portion C of FIG. 3.
Figure 7:
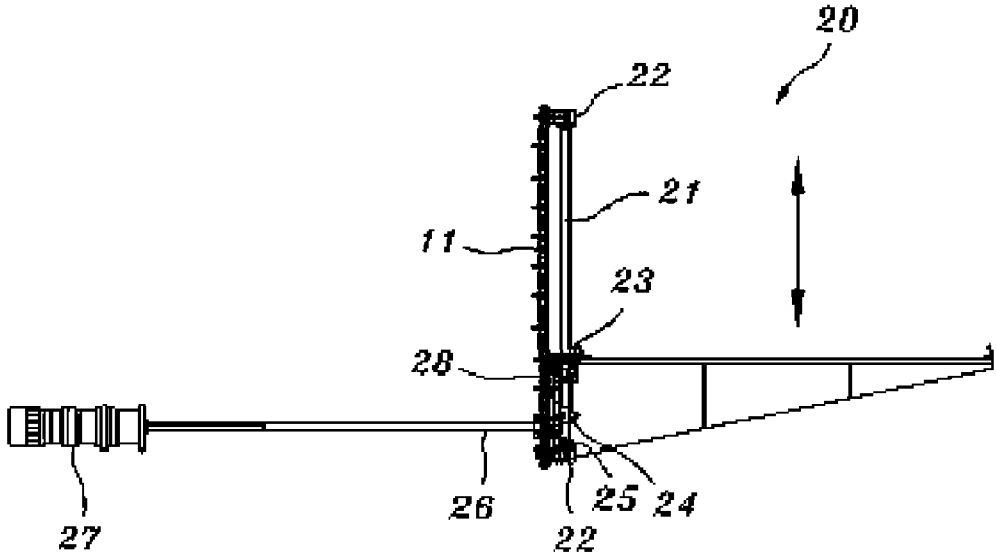
FIG. 7 is a side view showing a vertical moving table of the rear door system for transferring the hot cell equipment according to the embodiment of the present invention.
Figure 8:
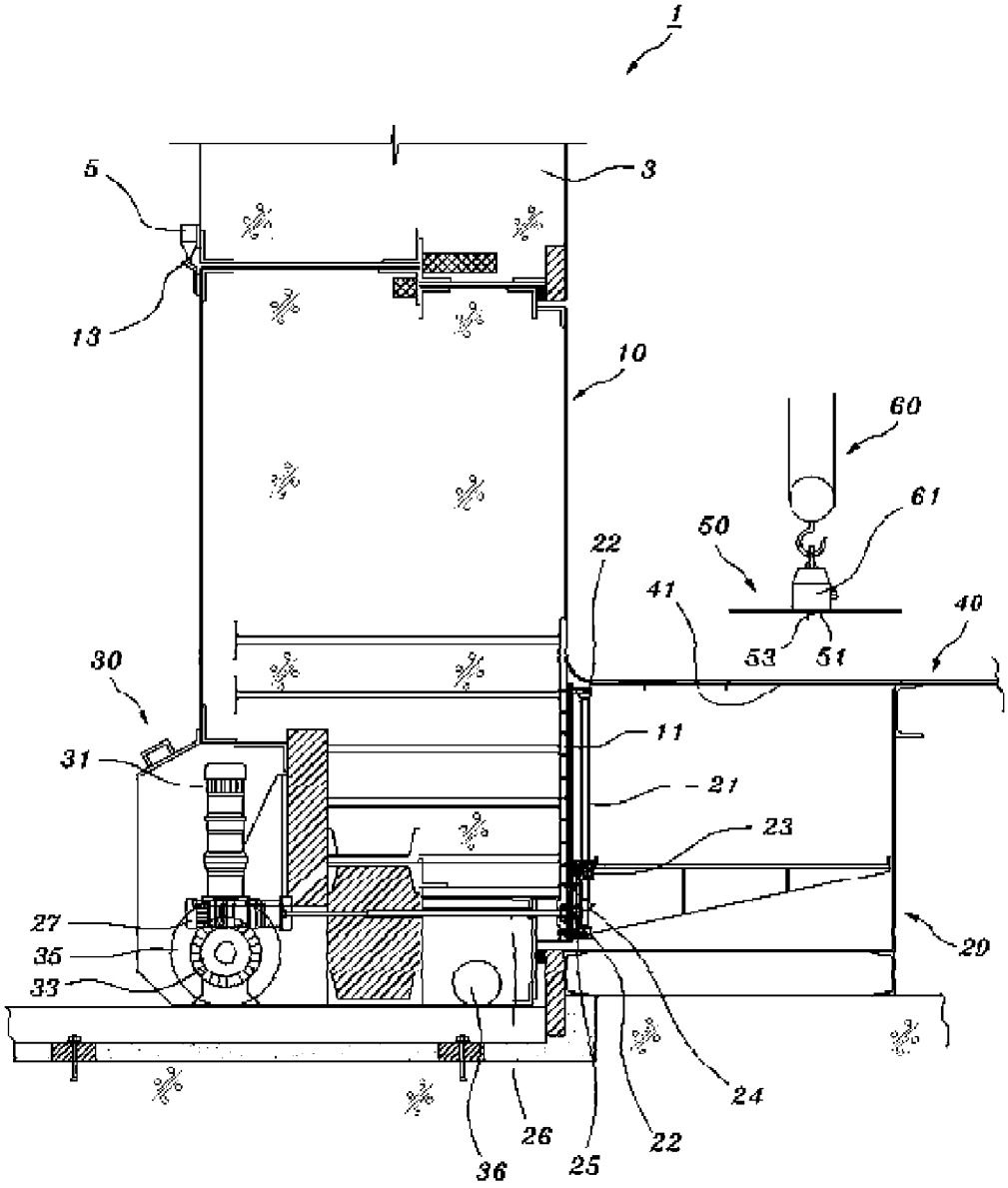
FIGS. 8, 9 and 10 are views illustrating the operation of the rear door system for transferring the hot cell equipment according to the embodiment of the present invention.
Figure 9:
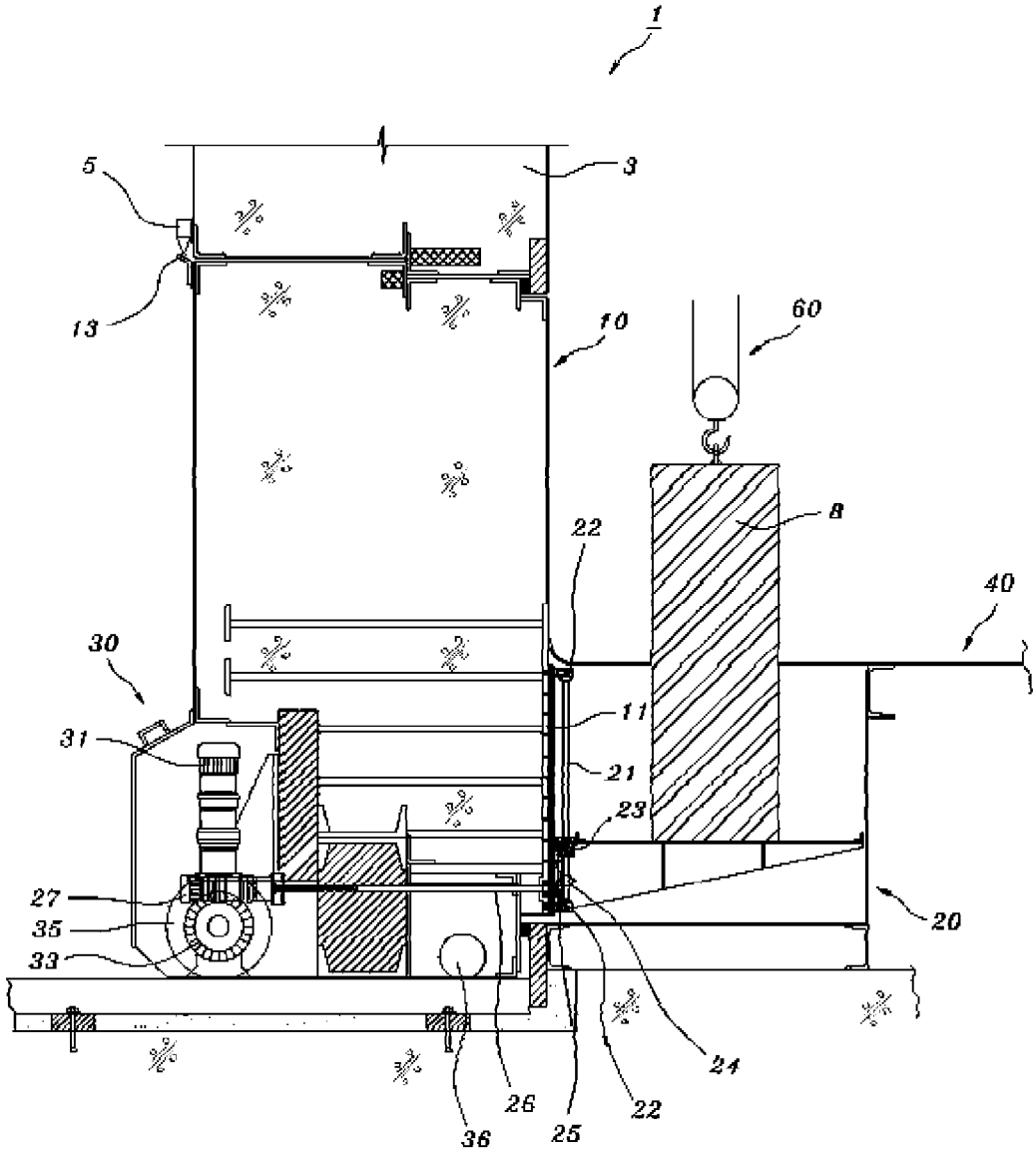
Figure 10:
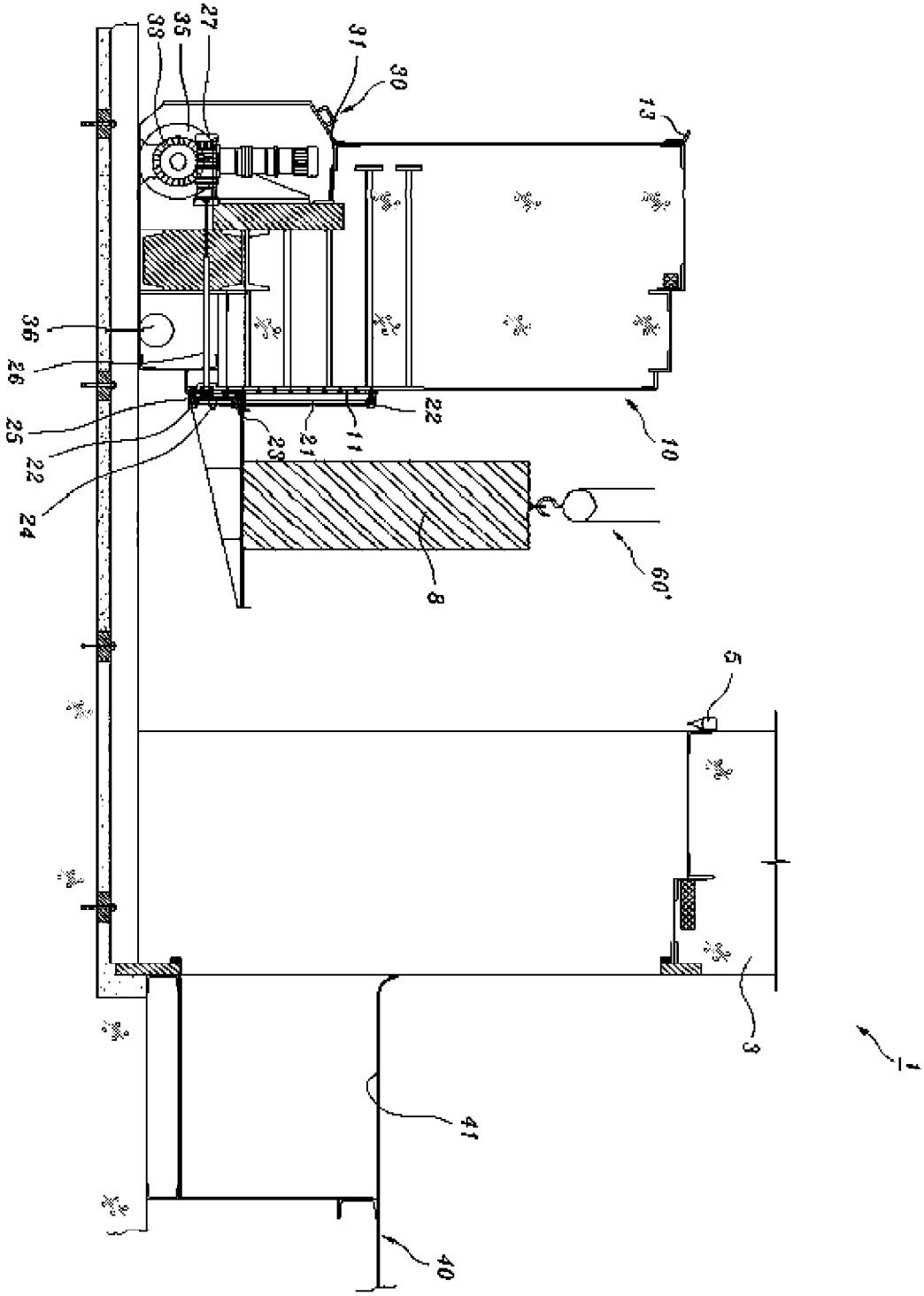

FIG. 1 is a front view schematically showing a rear door system for transferring hot cell equipment, according to an embodiment of the present invention. FIG. 2 is a rear view schematically showing the rear door system for transferring the hot cell equipment. FIG. 3 is a side view schematically showing the rear door system for transferring the hot cell equipment. FIG. 4 is a sectional view taken along the line A-A' of FIG. 3. FIG. 5 is a sectional view taken along the line B-B' of FIG. 3. FIG. 6 is an enlarged view of the circled portion C of FIG. 3. FIG. 7 is a side view showing a vertical moving table of the rear door system for transferring the hot cell equipment. FIGS. 8, 9 and 10 are views illustrating the operation of the rear door system for transferring the hot cell equipment.

As shown in the drawings, the rear door system 1 for a hot cell for transferring the hot cell equipment according to the present invention includes a rear door 10, a vertical moving table 20, a drive unit 30, a stationary working table 40, a removable table 50, a hot cell crane hook 60, and a service area crane hook 60'.

The rear door 10 is openably coupled to a rear wall 3 of a hot cell to carry the hot cell equipment 8 into or out of the hot cell. Two guide rails 11 are vertically provided on the lower portion of the front surface of the rear door 10 at predetermined respective positions opposite each other.

Furthermore, two clamps 15 are provided at predetermined positions on the respective opposite edges of the rear surface of the rear door 10. The clamps 15 serve to fasten the rear door 10 to the rear wall 3 of the hot cell for safety under normal conditions.

The vertical moving table 20 is coupled at a predetermined position to the lower portion of the front surface of the rear door 10 so as to be movable upwards and downwards along the guide rails 11, which are vertically provided on the lower portion of the front surface of the rear door 10.

To make it possible for the vertical moving table 20 to vertically move along the guide rails 11 of the rear door 10, at least one rail block 28 is provided on the rear surface of the vertical moving table 20, so that the vertical moving table 20 is movably coupled to the guide rails 11 by the rail block 28.

In the embodiment of the present invention, although two rail blocks 28 are provided at each of opposite positions on the rear surface of the vertical moving table 20, more than two or less than two rail blocks 28 may be provided at each of predetermined positions on the rear surface of the vertical moving table 20, so long as the vertical moving table 20 can be coupled to the guide rails 11, which are provided on the front surface of the rear door 10, so as to be easily movable upwards and downwards.

As such, the vertical moving table 20 is vertically movable on the front surface of the rear door 10 by coupling the rail blocks 28 of the vertical moving table 20 to the guide rails 11, which are provided at respective opposite positions on the lower portion of the front surface of the rear door 10.

Meanwhile, a ball screw 21 is provided through the end of the vertical moving table 20 so as to be rotatable. Support members 22 are provided on respective opposite ends of the ball screw 21. The support members 22 are fastened at predetermined positions to the front surface of the rear door 10. Furthermore, a ball nut 23, the upper end of which is coupled to the lower surface of the vertical moving table 20, is fitted over the ball screw 21 so as to be movable upwards or downwards depending on the rotation of the ball screw 21.

Here, a bevel gear 24 is provided on the lower end of the ball screw 21. The bevel gear 24 engages with a shaft gear 25 of a rotating shaft 26 which is rotatably coupled to the center of the end of a moving table driving motor 27.

In the above-mentioned construction, the rotating shaft 26, which is coupled to the moving table driving motor 27, is rotated by the operation of the moving table driving motor 27. The shaft gear 25 is rotated by the rotation of the rotating shaft 26. Then, the bevel gear 24 is rotated by the rotation of the shaft gear 25, thus rotating the ball screw 21. Thus, the ball nut 23, which is provided on the ball screw 21, is moved upwards or downwards by the rotation of the ball screw 21. Thereby, the vertical moving table 20, which is coupled to the upper end of the ball nut 23, is moved upwards or downwards.

The drive unit 30 is provided at a predetermined position in the lower end of the rear door 10 to move the rear door 10.

To achieve the above-mentioned purpose, the drive unit 30 includes a drive motor 31, a drive gear 32, which is provided on the lower end of the drive motor 31, a bevel gear 33, which engages with the drive gear 32, and a central shaft 34, which is coupled to the center of the bevel gear 33. The drive unit 30 further includes rear drive wheels 35, which are coupled to respective opposite ends of the central shaft 34 so as to be rotatable, and front wheels 36, which are provided ahead of the rear drive wheel 35.

Here, support guide rails 7 are provided at predetermined opposite positions on a support bottom, which extends from the lower surface of the rear wall 3 of the hot cell. The rear drive wheels 35 are placed on the respective support guide rails 7 so as to be movable forwards or backwards along the support guide rails 7.

Meanwhile, a dog 13 is provided at a predetermined position on the rear surface of the rear door 10. In addition, a limit switch 5 is provided on the rear wall 3 of the hot cell at a position corresponding to the dog 13. The dog 13 and the limit switch 5 are constructed such that they can come into contact with each other. When the dog 13 comes into contact with the limit switch 5, the drive motor 31 of the drive unit 30 is turned off, so that the rear door 10 is stopped.

The stationary working table 40 is disposed above the vertical moving table 20 and is horizontally fixed in the hot cell.

The stationary working table 40 is made of a typical stainless steel plate and is fixed to the upper end of a support structure (not designated by a reference numeral), which is placed on the bottom in the hot cell.

The removable table 50 is removably coupled at a predetermined position to the stationary working table 40. Furthermore, the removable table 50 is attached to a magnet 61 of the hot cell crane hook 60, which is provided in the hot cell, by the magnetic force of the magnet 61 and is moved upwards or downwards by the operation of the hot cell crane hook 60. In other words, the removable table 50 is removably coupled at the predetermined position to the stationary working table 40. For this, a receiving space 41 for installation of the removable table 50 is formed at the predetermined position through the stationary working table 40.

Here, a plurality of steel plates 51, which are attracted by the magnetic force of the magnet 61, is inserted in the upper surface of the removable table 50. In other words, the steel plates 51, which are provided in the upper surface of the removable table 50, become attached to the magnet 61 of the hot cell crane hook 60 by magnetic force, so that the removable table 50 is attached to or removed from the stationary working table 40 by operating the hot cell crane hook 60 having the magnet 61.

Furthermore, several reinforcing bars 53 for reinforcing the removable table 50 are horizontally provided under the lower surface of the removable table 50 at positions spaced apart from each other in a longitudinal direction at predetermined intervals.

As such, because the steel plates 51 are provided in the removable table 50, a process of attaching or removing the removable table 50 to or from the stationary working table 40 can be easily conducted using the magnet 61 of the hot cell crane hook 60. Furthermore, the removable table 50 is reinforced with several reinforcing bars 53. Thanks to the reinforcing bars 53, the removable table 50 is prevented from sagging.

Hereinafter, the operation of the rear door system for transferring the hot cell equipment according to the present invention will be explained herein below with reference to FIGS. 8, 9 and 10.

First, when it is desired to carry the hot cell equipment 8 out of the hot cell using the rear door system 1 of the present invention, the magnet 61 is hung on the hot cell crane hook 60 and, thereafter, the hot cell crane hook 60 is moved downwards such that the magnet 61 provided on the end of the hot cell crane hook 60 is disposed on the upper surface of the removable table 50. Then, the removable table 50 is attached to the magnet 61 by the magnetic force of the magnet 61.

After the removable table 50 is attached to the magnet 61 of the hot cell crane hook 60, the hot cell crane hook 60 is moved upwards to remove the removable table 50 from the stationary working table 40. Subsequently, the magnet 61 and the removable table 50, which is attached to the magnet 61 using the magnetic force, are removed from the hot cell crane hook 60.

Thereafter, the hot cell equipment 8, which is placed in the hot cell, is held by the hot cell crane hook 60 and is moved into the space in which the removable table 50 was disposed, that is, the receiving space 41 of the stationary working table 40.

Then, the hot cell equipment 8 is placed on the upper surface of the vertical moving table 20, which is disposed below the stationary working table 40.

As such, after the hot cell equipment 8 has been placed on the vertical moving table 20, the drive unit 30, which is provided in the lower end of the rear door 10, is operated to move the rear door 10 out of the hot cell.

To move the rear door 10, the drive motor 31 of the drive unit 30 is operated, and then the drive gear 32, which is provided on the lower end of the drive motor 31, is rotated. Thus, the bevel gear 33, which engages with the drive gear 32, is rotated by the rotation of the drive gear 32. Then, the central shaft 34, which is coupled to the center of the bevel gear 33, and the rear drive wheels 35, which are provided on the opposite ends of the central shaft 34, are rotated by the rotation of the bevel gear 33. As a result, the rear door 10 is moved.

Here, when the rear drive wheels 35, which are provided under the rear door 10, are rotated, the front wheels 36, which are disposed ahead of the rear drive wheels 35, are rotated along with the rear drive wheels 35 to move the rear door 10.

Furthermore, when the rear door 10 is moved forwards or backwards by the drive unit 30, the rear drive wheels 35 are moved along the respective support guide rails 7, which are provided at predetermined opposite positions on the support bottom both in an opening of the rear wall 3 of the hot cell and in a service area.

As such, after the rear door 10 is moved along the support guide rails 7 and is spaced apart from the rear wall 3 of the hot cell by a predetermined distance, the hot cell equipment 8, which is placed on the upper surface of the vertical moving table 20, is held by a service area crane hook 60', which is disposed in the service area outside the hot cell, and is moved to a desired location.

In the present invention, the vertical position of the hot cell equipment 8, which is placed on the upper surface of the vertical moving table 20, can be adjusted. In detail, depending on the size or height of the hot cell equipment 8 that is placed on the upper surface of the vertical moving table 20, the vertical position of the hot cell equipment 8 can be adjusted by vertically moving the vertical moving table 20.

To achieve the above-mentioned purpose, the moving table driving motor 27 is operated, so that the rotating shaft 26, which is coupled to the center of the end of the moving table driving motor 27, is rotated. Thus, the shaft gear 25, which is coupled to the end of the rotating shaft 26, is rotated by the rotation thereof, and the bevel gear 24, which engages with the shaft gear 25, is rotated by the rotation of the shaft gear 25. Thereby, the ball screw 21 is rotated, so that the ball nut 23, which is provided on the ball screw 21, is moved upwards or downwards by the rotation of the ball screw 21. As a result, the vertical moving table 20, which is coupled to the upper end of the ball nut 23, is moved upwards or downwards, thus adjusting the vertical position of the hot cell equipment 8.

After the hot cell equipment 8 is moved to the service area crane hook 60' from the vertical moving table 20 of the rear door 10, which has been moved into the service area outside the hot cell through the above-mentioned process, the rear door 10 is moved to the rear wall 3 of the hot cell again.

At this time, the movement of the rear door 10 towards the rear wall 3 of the hot cell is conducted in the order reverse to that of the above operating process. When the dog 13, which is provided at a predetermined position on the upper end of the rear door 10, comes into contact with the limit switch 5, which is provided on the rear wall 3 of the hot cell at the position corresponding to the dog 13, the movement of the rear door 10 is stopped.

For this, the dog 13, which is provided on the upper end of the rear door 10, is connected to the drive unit 30, which is provided in the lower end of the rear door 10. In other words, the drive unit 30, which moves the rear door 10, is connected to the dog 13, which is provided on the upper end of the rear door 10 and is set such that, when the rear door 10 is closed to the rear wall 3 of the hot cell, the dog 13 is brought into contact with the limit switch 5. Furthermore, when the dog 13 is brought into contact with the limit switch 5, the dog 13 stops the operation of the drive unit 30. Therefore, every time the rear door 10 is closed, it can be precisely disposed at the same position in the rear wall 3 of the hot cell.

As described above, a rear door system for transferring hot cell equipment according to the present invention has an improved structure in which a vertical moving table is vertically moved on the rear door of a large hot cell that handles highly radioactive material but cannot have a roof door. Thus, an operation of transferring the hot cell equipment, which is relatively large or heavy and is highly radioactive, into or out of the hot cell can be conducted using only the rear door. Therefore, the present invention can make it easy to transfer the hot cell equipment and prevent a user from being directly exposed to radiation, thus preventing the user from being subjected to safety hazards that may occur when transferring the hot cell equipment.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A rear door system for transferring hot cell equipment into or out of a hot cell, comprising:

a rear door configured to be placed on a rear wall of the hot cell, the rear door being movable to open or close the rear wall of the hot cell;

a vertical moving table provided at a predetermined position on a lower portion of a front surface of the rear door so as to be movable upwards or downwards;

a drive unit provided at a predetermined position in a lower end of the rear door to move the rear door;

a stationary working table disposed above the vertical moving table and configured to be fixed to the hot cell in a horizontal orientation;

a removable table removably coupled at a predetermined position to the stationary working table;

a hot cell crane hook and a service area crane hook; and two clamps which are provided at predetermined positions on the respective opposite edges of the rear surface of the rear door for fastening the rear door to the rear wall, wherein guide rails are vertically provided at respective predetermined opposite positions on the lower portion of the front surface of the rear door, and a plurality of rail blocks are provided at each of predetermined opposite positions on a rear surface of the vertical moving table and is coupled on each of the guide rails, wherein a plurality of reinforcing bars is horizontally provided under a lower surface of the removable table at positions spaced apart from each other in a longitudinal direction at predetermined intervals, wherein a magnet is provided on the hot cell crane hook.

2. The rear door system as set forth in claim 1, wherein the vertical moving table comprises: a ball screw provided through an end of the vertical moving table so as to be rotatable; support members provided on respective opposite ends of the ball screw and configured to be fastened at respective predetermined positions to the front surface of the rear door; a ball nut coupled to the ball screw so as to be movable upwards or downwards; a bevel gear provided on a lower end of the ball screw; a shaft gear engaging with the bevel gear in a horizontal direction; a rotating shaft coupled at an end thereof to the shaft gear and provided so as to be rotatable; and a moving table driving motor coupled to the rotating shaft.

3. The rear door system as set forth in claim 1, wherein a receiving space having a predetermined size corresponding to a size of the removable table is formed at a predetermined position through the stationary working table.

4. The rear door system as set forth in claim 1, wherein a plurality of steel plates, which are attracted by magnetic force, is provided in an upper surface of the removable table.

* * * * *